United States Patent [19]

Fidler

[11] Patent Number: 4,978,042

[45] Date of Patent: Dec. 18, 1990

[54] INK FEEDER FOR A LITHOGRAPHIC PRESS

[76] Inventor: Kenneth Fidler, 2519 Mayfair Dr., Lancaster, Pa. 17603

[21] Appl. No.: 340,116

[22] Filed: Apr. 17, 1989

[51] Int. Cl.[5] ..... G04C 23/00; B67D 5/06

[52] U.S. Cl. ..... 222/642; 222/185; 222/326; 222/334

[58] Field of Search ..... 222/52, 63, 639, 642, 222/644, 185, 309, 325–327, 333–334, 386, 389–390

[56] References Cited

U.S. PATENT DOCUMENTS

| | | | |
|---|---|---|---|
| 2,105,990 | 1/1938 | Schultz et al. | 222/325 |
| 2,728,493 | 12/1955 | Spurgeon | 222/390 X |
| 2,822,959 | 2/1958 | Soehnlen et al. | 222/390 X |
| 2,831,606 | 4/1958 | Alters | 222/390 X |
| 3,281,020 | 10/1966 | Steiner | 222/162 |
| 3,282,473 | 11/1966 | Moore | 222/327 |
| 3,327,906 | 6/1967 | Gomann | 222/389 |
| 3,456,849 | 7/1969 | Sjostrand | 222/327 |
| 3,804,012 | 4/1974 | Bosshardt | 101/122 |
| 3,904,083 | 9/1975 | Little | 222/82 |
| 3,982,667 | 9/1976 | Chen | 222/642 |
| 4,275,822 | 6/1981 | Juffa et al. | 222/63 |
| 4,355,734 | 10/1982 | Moore | 222/63 |
| 4,479,433 | 10/1984 | MacPhee et al. | 101/364 |

FOREIGN PATENT DOCUMENTS

| | | | |
|---|---|---|---|
| 2051958 | 4/1971 | France | 222/309 |

*Primary Examiner*—Michael S. Huppert

*Attorney, Agent, or Firm*—Biebel, French & Nauman

[57] ABSTRACT

A feeder for expelling printing ink from an ink can or container directly into an ink fountain of a printing press comprising a housing having a section for receiving an ink can in a centered location, a bottom opening through which ink can be expelled from the can, and a top section in which a double acting pneumatic cylinder is supported over the ink can. The cylinder has a ram carrying an expeller plate for pushing printing ink from an ink can supported below the ram. A disc seal member is interposed between the plate and the surface of ink in the can, and forms a seal with the inner diameter of the can. This seal can remain in a partially empty can to protect the ink surface. An electrical circuit controls the operation of the feeder, and is contained in the housing. The control includes a switch having position for manual advancement and retraction of the expeller plate, and a position for automatic operation of the feeder. In the automatic mode, a timer controls the energizing and de-energizing of a control relay to activate the pneumatic cylinder and extend the ram in incremental fashion to push ink out of the ink can. The duration and frequency of expeller plate advancement can be varied to adjust the amount of ink expelled in a given period of press operating time.

14 Claims, 5 Drawing Sheets

INK FEEDER FOR A LITHOGRAPHIC PRESS

BACKGROUND OF THE INVENTION

This invention relates to a feeder for expelling thick viscous printing ink from ink storage containers, primarily cylindrical cans, directly into an ink fountain of a printing press.

The ink consumption in a modern, high speed lithographic press can be considerable. Little attention has been given to providing assistance to the pressman in keeping an adequate level of ink in the pan of press's ink fountain.

Most lithographic printing inks are quite viscous, comparable to thick molasses or a heavy grease. As a result, such ink does not flow readily and requires considerable pumping pressure if some form of pump is used to transfer the ink from a storage container. Typically, inks used in printing job shops are supplied in sealed cylindrical cans of about five pound capacity, although the exact diameter of such cans may vary somewhat from one supplier to another. A number of reasons dictate this such as convenience in storage and handling, ability to keep the ink under seal until it is ready for use, and frequent need to change colors in different relatively short runs that are common to such shops.

As a result, a commonly employed method for keeping correct level of ink in a press fountain is for the pressman to open a can as needed and, as he observes a need for more ink in the fountain, scoop a large mass of the thick viscous ink from the can, using a wide spatula type knife, and "wipe" it into the ink fountain pan or against the fountain roller of the ink fountain if the press is momentarily not operating. Where larger presses and/or longer runs are involved, it may be desirable to use some sort of pump (either manual or motor operated) under control of the pressman to transfer ink from a can to the fountain pan.

When such presses are running longer jobs, and using the same color ink in greater quantities, on the same equipment, the frequent attendance of the pressman to this ink supply task becomes something of a burden. Any arrangement for making his job simpler at this time, or requiring less repeated attendance to the ink fountain, enables him to spend more uninterrupted time concentrating on other tasks such as washing up or making ready another press in the shop, or attending to other necessary duties.

No two jobs are alike in ink demand, so any equipment for partially automated ink feeding must be capable of adjusting the ink feed rate to keep up with, but not exceed, the printing press's utilization of the ink. In addition, the feeder equipment should be able to sense and inform the operator that an ink can in use has been depleted and should be replaced.

SUMMARY OF THE INVENTION

The present invention is a feeder for expelling or feeding lithographic printing ink from an ink storage container or can, in which the ink is purchased and stored at a printing establishment, directly into an ink fountain of a printing press, and to empty the ink from the can into the press fountain at a selected rate which allows the entire contents of the can to be emptied with little or no further attention. The feeder comprises a mounting plate securable to an ink fountain, directly over the fountain pan, of a press, and a feeder housing supported on such plate and of a size to receive a range of sizes of ink storage containers or cans, and including guide means for locating an ink can therein. When a can is prepared for placing in the feeder housing, its top is removed, and a suitable hole is formed in its bottom, preferably near the center of the bottom. The ink is so viscous that little or none of it flows out such an opening, but if necessary a spatula can be held across the opening as the can is located in the guide means.

An opening is located in the bottom of the feeder housing, in predetermined relation to the guide means, so ink forced through the thus formed bottom opening in the can will flow through the such opening and can be expelled into the press fountain directly from an ink can. Above the feeder housing there is mounted a ram means, such as a pneumatic cylinder, having a reciprocally moving rod which can extend into the feeder housing, and including an expeller plate corresponding in shape to the cross-sectional configuration of the ink can and movable downward in alignment with the guide means into the can to expel ink out through the can bottom.

A control is provided for the ram including an adjustable timer which permits selection of the rate and the duration of downward (feeding) motion of the expeller plate. Thus, upon setting up a new job and initiating operation of the feeder, the pressman can set the timing of the ram control to cause automatically a feeding motion of the expeller plate every x seconds with each motion lasting for y seconds. Experience with the unit and knowledge of the ink demand for particular jobs, in a particular press, will enable the pressman to choose and/or adjust these settings such that the feeder will just keep up with the ink demand for the job in question. A detector is incorporated into the ram control for signalling when the expeller plate has reached the bottom of a can in the feeder housing and the ink supply in the can is depleted. This detector will actuate an indicator, preferably both a visual and audible indicator, to call attention of the pressman that more ink may be needed if the job is not about to be completed. It should be kept in mind, that depletion of the ink in the can leaves a sufficient quantity of ink in the ink fountain to continue for a considerable number of further impressions.

The control also allows for manual control of expeller feeding and retracting motion, so the pressman can easily retract the expeller plate from a depleted can, and bring the plate into contact with the top of ink in a full can.

Most ink containers are packed with an oiled paper (or the like) skin resting on the top of the ink before the can is sealed. The expeller plate can simply press against this paper if desired, but it is preferred, and is a further feature of the invention, that a wiping/sealing diaphragm member be inserted between the lower face of the expeller plate and the skin paper in the can. This member has a diameter somewhat greater than the inner diameter of the ink can, thus its edges will form around the periphery of the expeller plate and act to prevent flow of ink back around the edges of the expeller plate, and also to wipe the inner surface of the can as the plate descends therein.

Other objects and advantages of the invention will be apparent from the following description, the accompanying drawings, and the appended claims.

DESCRIPTION OF THE PREFERRED EMBODIMENT

Figure 1:
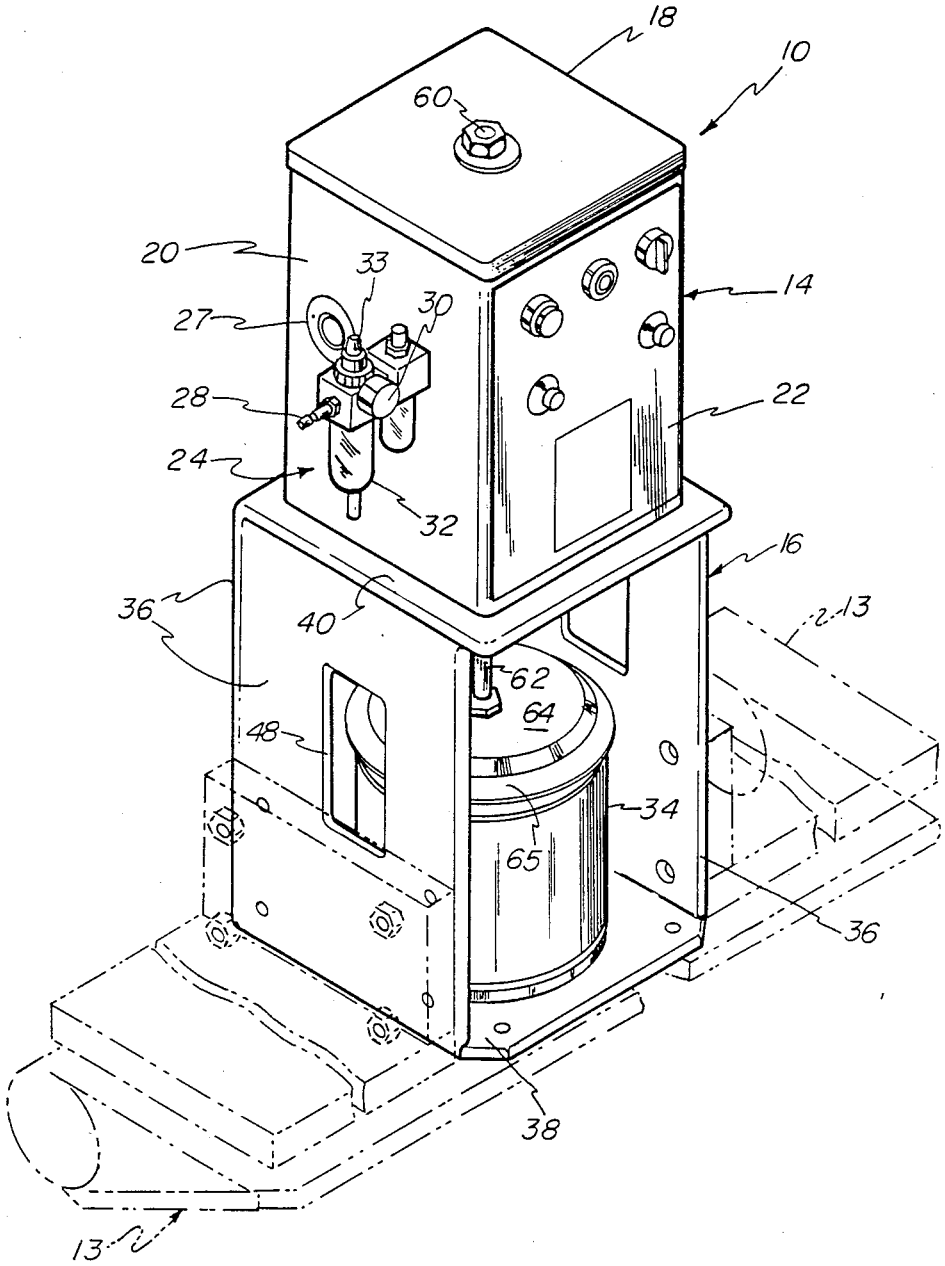
FIG. 1 is a perspective view of a feeder of the present invention for expelling printing ink from an ink storage container or can directly into an ink fountain of a printing press.
Figure 2:
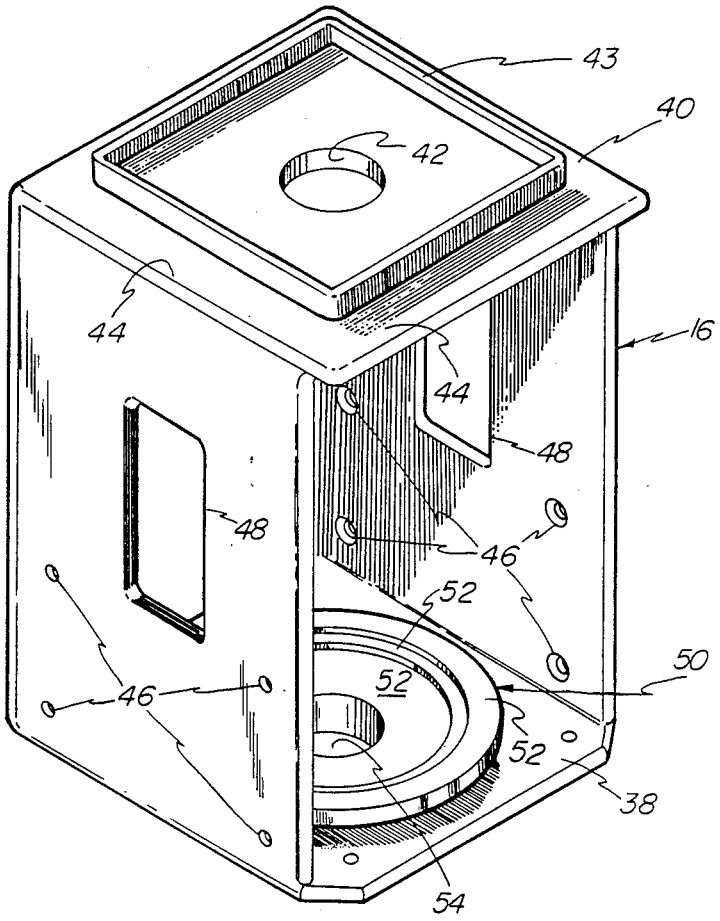
FIG. 2 is a perspective view of the ink feeder housing itself.
Figure 3:
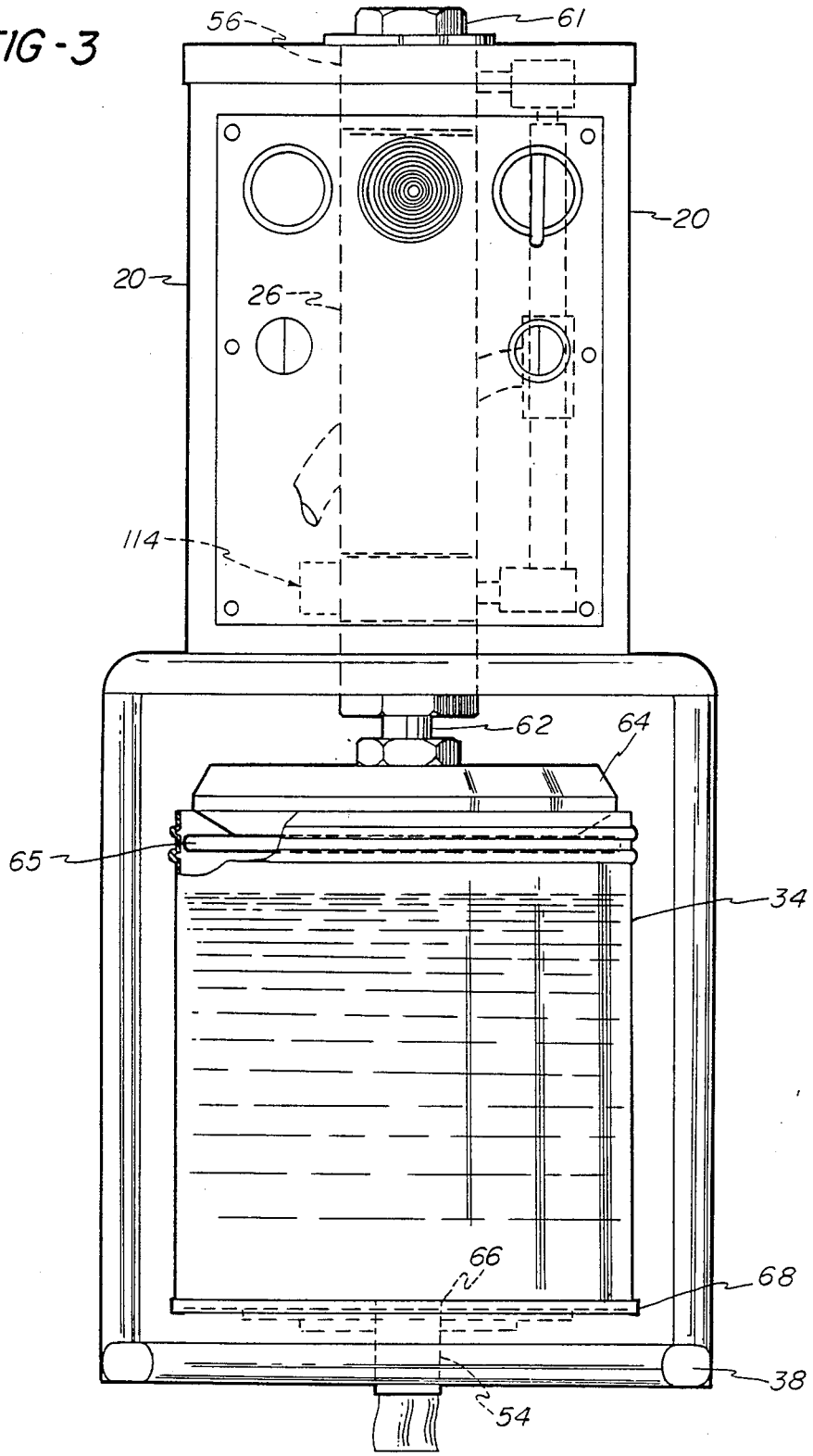
FIG. 3 is a front elevational view of the feeder showing the control housing and (in dotted lines) the pneumatic cylinder ram contained therein, and the ink storage container housing with a full ink can in position for dispensing of ink.

A feeder, generally designated 10, for expelling printing ink from an ink storage container or can directly into an ink fountain 13 of a printing press is shown in FIGS. 1, 2 and 3, comprising a control and pneumatic ram housing 14 and an ink can housing 16. The control housing 14 has a generally rectangular shape having a top wall or cover 18, three side walls 20 and a front control panel 22.

Mounted to one side wall 20 is a conventional air filter/regulator/valve assembly 24 for supplying air under pressure to a pneumatic cylinder 26 (FIG. 3) through conventional solenoid operated valves, and a conventional electrical hookup 27 for connecting the electric control to a power cord (not shown). The air valve assembly 24 includes a fitting 28 which can be connected to a shop air pressure hose (not shown), a pressure gage 30, and may include a conventional pressure regulator with an adjustment knob 33, a filter, and a lubricator. All these are conventional parts of a commercially available assembly.

As shown in FIGS. 1 and 2, the ink storage container housing 16 has a generally rectangular shape of a size to accommodate a conventional six inch diameter ink can or container 34. Housing 16 has three side walls 36, a bottom wall 38 and a top wall 40, leaving an open side through which ink cans may be loaded and unloaded from the feeder. Top wall 40 includes a central threaded hole 42 surrounded by a generally rectangular shaped ridge 43 equally spaced from edges 44 of top wall 40, for centering the control housing 14 on the ink storage container housing 16.

Side walls 36 and bottom wall 38 of the ink can housing 16 include apertures 46 for receiving mounting screws or bolts to attach different forms of support brackets to the housing, for mounting the feeder 10 to a particular press over its ink fountain, as shown in phantom lines in FIG. 1. Rectangular slots 48 are provided through side walls 36 allowing viewing of the container 34 by the pressman during operation of the feeder 10.

As shown in FIGS. 2 and 3, bottom wall 38 includes an ink container adapter plate 50 having circular centering rings or shelves 52, each shelf 52 being sized to receive a conventional size ink can 34 of somewhat different diameter, and providing a means for guiding the ink can 34 into proper alignment with an opening 54 formed in the bottom wall 38 of feeder housing 16. The largest size of can fits around the edge of member 52, as shown in FIG. 3. When preparing and loading a can of ink into the housing, the pressman makes a hole 55 in the bottom of the can (or uncovers one if the can has been partially used before), in a location which has the same alignment to the can perimeter as the opening 54 has to the center of the guiding rings 52. Thus, when the can is so mounted there is a passage from the can bottom through which ink can be expelled into the ink fountain of the press.

As shown in FIGS. 1, 2 and 3, the cover or top wall 18 of the control housing 14 includes central hole 56 through which extends a threaded upper end 60 of the pneumatic cylinder 26. A nut 61 holds the cylinder vertically in the control housing 14. The lower end of cylinder 26 is threaded into hole 42, and the rod or ram 62 of the cylinder assembly extends into the lower container housing. Thus, the control housing is easily assembled on top of the container housing by threading the lower end of the pneumatic cylinder assembly into the hole 42, then placing the square tube member forming the sides of the control housing around the cylinder assembly, seated around the ridge 43. The cover is placed over the top of the cylinder assembly, and nut 61 attached, thus clamping the upper housing in place. The detachable control panel 22 can be added at the appropriate time to completely enclose the cylinder assembly, with the control circuitry also enclosed, mounted to the rear of the panel.

An expeller plate 64 which is corresponding in shape to the cross-sectional configuration of the ink can 34, is fixed to the end of the ram 62. When a can is located in feeding position, the plate 64 is slidably received therein for downward movement to expel ink out opening 55 in the can bottom.

Most ink cans are packed with an oiled paper (or the like) "skin", of generally disc shape, resting on the top of the ink before the can is sealed. This paper disc is intended primarily to impede degradation of the upper surface of the ink should the can be left unsealed, but the ink not used immediately. It does not, however, seal closely with the inner side of the can. In many normal uses, this disc often is simply removed and discarded. In the use of the present invention, the expeller pate 64 can simply press against this paper if desired. However a preferred arrangement, which is another feature of the invention, is to provide a wiping/sealing diaphragm member 65 which is inserted between the lower face of the expeller plate and the surface of the ink (or the skin) in the can. This member 65 has a diameter which provides a close fit to the inner diameter of the ink can, thus its edges will extend beyond the periphery of the expeller plate 64 and the inner surface of the ink can 34, acting to prevent flow of ink back around the edges of the expeller plate, and also to wipe the inner surface of the can as the plate descends therein.

Member 65 may be formed, preferably, from closed cell polypropylene or equivalent material which is of limited flexibility, inexpensive and also disposable. It has the advantage of providing a wiper/seal which can remain with the ink can. If the ink is partially used, the disc provides a seal against exposure of the ink surface to the atmosphere and minimizes or avoids the formation of a "skin" on the upper surface of the remaining ink. Otherwise, when the can is next used the pressman must remove and discard this useless "skin" and it is expected that upcoming more stringent environmental standards will make the disposal of that material more difficult. By eliminating this problem, the present invention presents a significant advantage.

Figure 4:
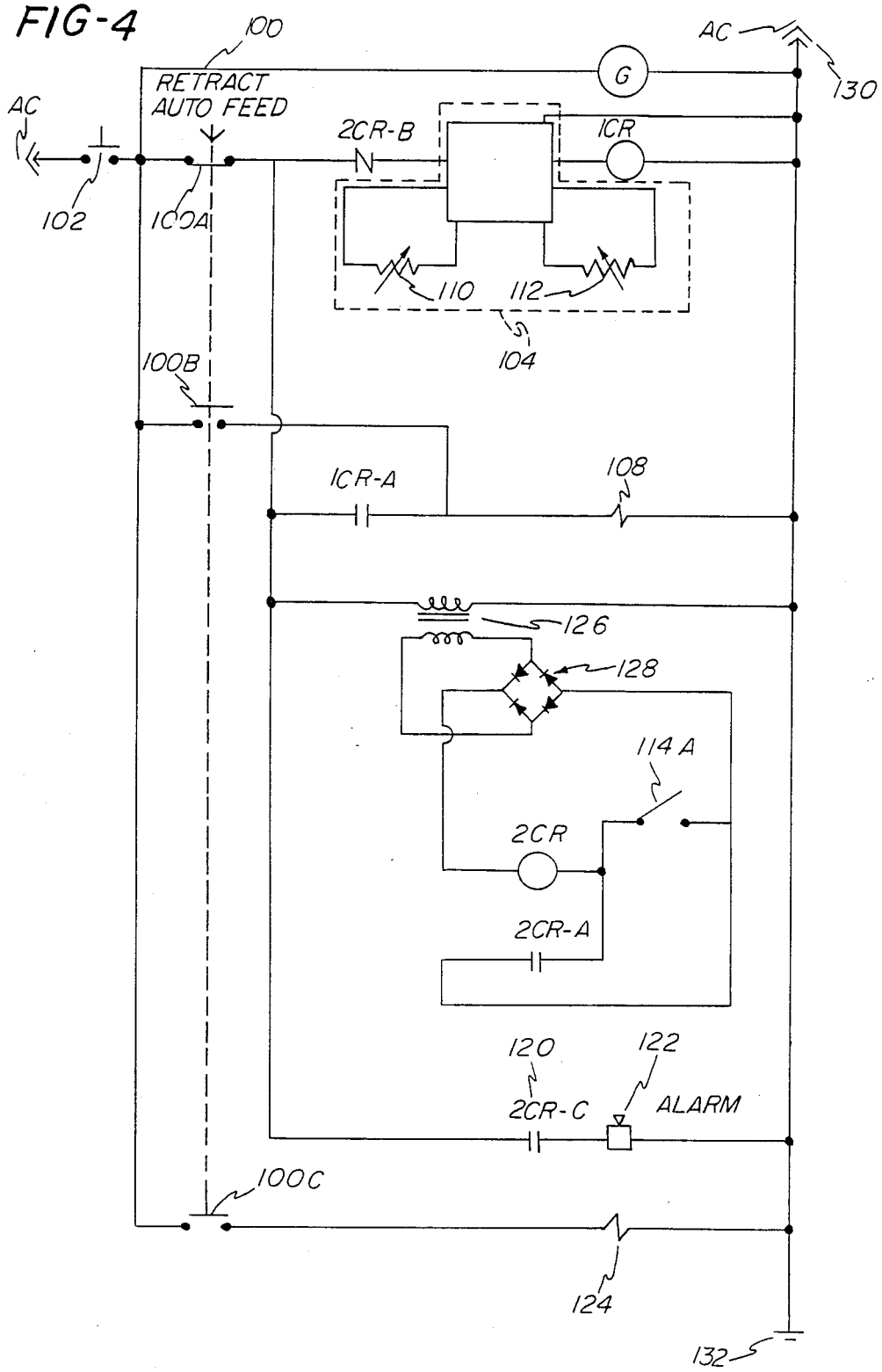
FIG. 4 is an electrical schematic diagram of the control circuit for the feeder.

Referring to the wiring diagram, FIG. 4, the control for the ink feeder features three modes of operation. There are manually selectable modes during which the expeller plate may be lowered or raised under operator control. There is also an automatic mode during which the expeller plate, starting with a relatively full ink can, will advance in a series of timed downward movements of the ram, to feed selected incremental quantities of ink from the can into the fountain. The control circuit incorporates a three-position selector switch 100 having contacts 100A, 100B and 100C, only one of which may be closed at a time, and defining respectively an automatic mode, a ram retract mode, and a continuous ink feed mode of the control. Each of the selector switch contacts is connected to an AC power supply through a manual power on-off switch 102.

When selector switch 100 is in "continuous" ink feed position, contact 100B is closed and ink feed valve solenoid 108 is energized to feed an starting quantity of ink into the fountain under operator surveillance. To stop the ink feed, the pressman simply turns the power switch 102 off.

When selector switch 100 is in the "retract" position, contact 100C is closed and retract valve solenoid 124 is energized, the cylinder 32 retracts the ram 62. No other function of the feeder operates when the switch 100 is in this position. It will normally be used when a job is completed without depleting the ink in the can, so the pressman can free the can for removal and sealing, to save the remaining ink for use at a later date.

For automatic operation of the ink feeder 10, selector switch 100 is placed in the "auto" position (the position shown in FIG. 4) which activates a dual timing function solid state electronic timer 104 for setting energizing time and de-energizing time for relay 1CR. Thus, when "auto" operation is selected, relay 1CR is energized to activate timer 104 and to close its normally open contact 1CR-A, supplying power to ink feed valve solenoid 108 on the pneumatic assembly. This causes the pneumatic cylinder 26 to extend ram 62 and push ink out of can 34 and into the ink fountain.

Timer 104 includes provisions for adjusting both its "on" and "off" times. Thus, the timer includes a first adjustable linear potentiometer 110 which sets the time before the relay 1CR is de-energized, so as control the period of time (and thus the overall rate) of ink flow into the ink fountain. The timer 104 further includes a second linear potentiometer 112, referred to as a "dwell" control, to control length of the time before relay 1CR is again energized. By adjusting these two controls, a pressman can, based on experience with the control, the various types of ink used, and his judgment as to the amount of ink used in a given job according to the coverage required, set the control to expel a desired quantity of ink into the fountain in desired increments. This allows the control to keep up with the press demand, and yet not overfill the fountain.

When expeller plate 64 reaches the bottom of the ink can 34, the can is presumed empty. This is determined by a sensor means such as a limit switch 114 associated with ram 62. Its contact 114A closes to energize the coil of a DC relay 2CR.

A single-phase isolation transformer 126 and full wave rectifier 128 are used to provide DC voltage to relay 2CR and its circuit including the limit switch 114, thus isolating it from the higher voltage of the main control circuit, since the limit switch is incorporated into the pneumatic ram assembly. After relay 2CR is energized, its contacts 2CR-A close and bypass the limit switch, locking relay 2CR on. Simultaneously, normally open contacts 2CR-B open and both the timer 104 and relay 1CR are de-energized. Further, contacts 2CR-C close to actuate the alarm 122, which may be both audible and visible, e.g. a horn and lamp. When the pressman notices the alarm, he attends the press, transfers the selector switch to the "retract" mode, and removes the empty ink can once the expeller plate is fully withdrawn from the ink can.

Figure 5:
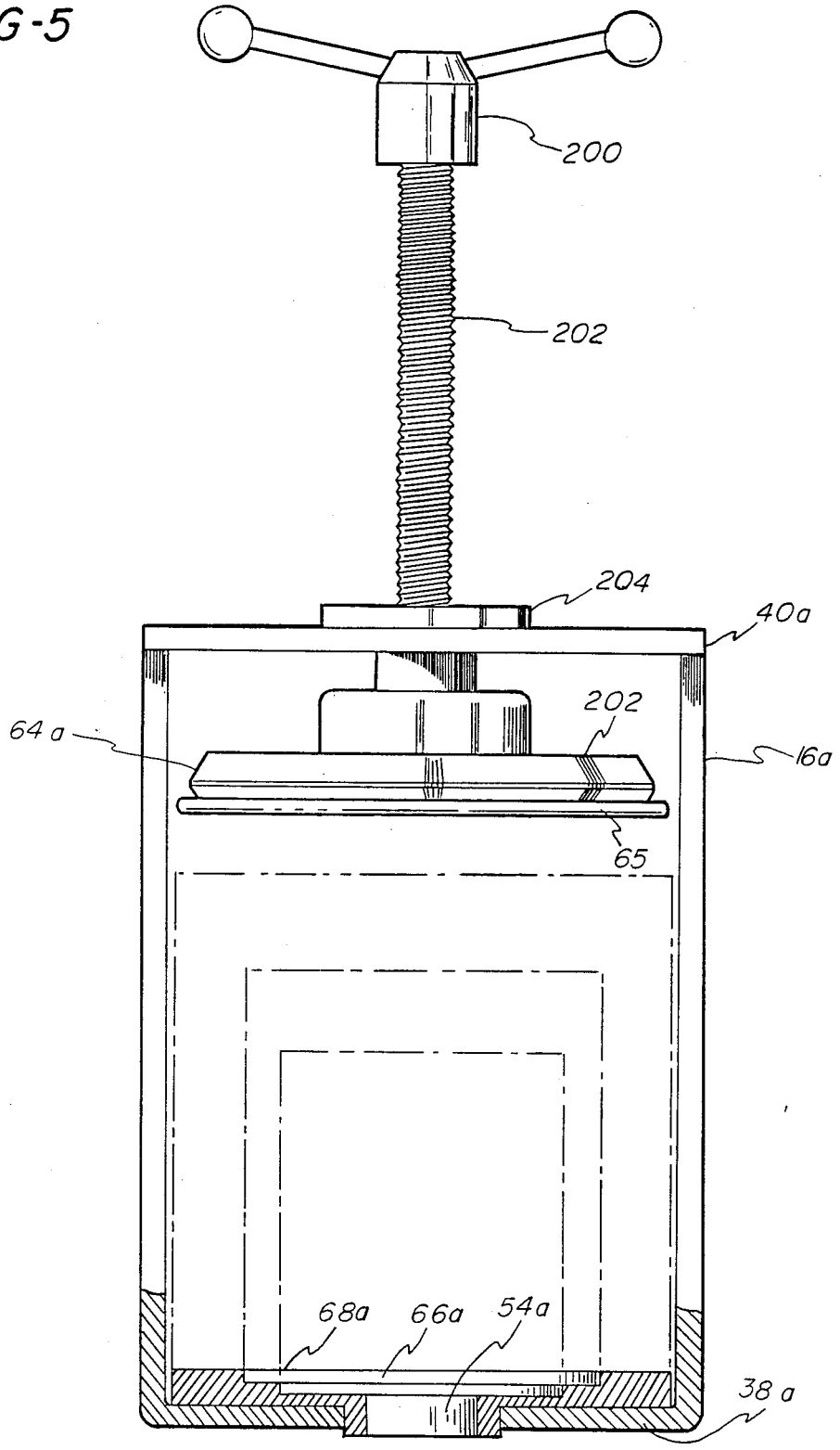
FIG. 5 is a front elevation view of another embodiment of the feeder, showing a manually operated screw feed for the expeller plate.

Preferably, control housing 14 is provided with an AC ground which will avoid accidental shock to the pressman should some fault occur in the control circuit. Another embodiment of the invention, a simplified form for use where semi-automatic control is not of importance, is shown in FIG. 5. The pneumatic cylinder assembly and associated control housing is replaced by a ball handle 200 mounted to one end of a threaded rod 202. The threaded rod 202 extends through top wall **40*a* of the ink storage container housing 16*a* and is supported by a bushing 204. Mounted to the other end of the threaded rod 202 is an expeller plate 64*a* slidably received in an ink storage container (shown in phantom) for expelling ink out an opening 66*a* in the container bottom 68*a* and through opening 54*a* in the bottom wall 38*a* of the storage housing 16*a***.

In operation, the operator periodically observes the level of the ink in the ink fountain. If ink is required, he simply turns the ball handle 200 thereby advancing the threaded rod 202 downwardly causing the expeller plate **64*a* to push the ink out through opening 66*a*. When the threaded rod 202 is fully extended, indicating that the ink storage container 34*a* is empty, the operator simply reverses the direction of rotation of the ball handle 200 thereby retracting the threaded rod 202 and expeller plate 64*a* upwardly out of the ink storage container 34*a*** allowing replacement of the container.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A feeder for expelling printing ink from an ink storage can directly into an ink fountain of a printing press, comprising:

a housing adapted to be mounted over the ink fountain of a press;

a double acting fluid pressure actuated ram means mounted in said housing to act along a path toward and away from the fountain;

control means including a timer for periodically advancing said ram means;

support means in said housing for receiving and locating an ink storage can in the path of said ram means;

an expeller plate carried by said ram means for movement from a position above an ink storage can to a position adjacent to the bottom of an ink storage can and dimensioned to fit within an ink storage can; and said ink can support means having a bottom opening through which ink can be expelled as the ink is forced through a hole formed in the bottom of a can placed in said support means.

2. An ink feeder as defined in claim 1, further comprising a diaphragm member located below and in contact with said expeller plate, said diaphragm member being sized and adapted to contact the interior of a can for minimizing leakage of ink between the can wall and the periphery of said expeller plate.

3. An ink feeder as defined in claim 1, wherein said control means includes sensing means for sensing when the ink storage can is empty.

4. An ink feeder as defined in claim 3, wherein said sensing means is a limit switch actuated by said ram when said expeller plate reaches the bottom of a storage can.

5. An ink feeder for expelling printing ink from an ink container of predetermined cross-sectional configuration directly into an ink fountain of a printing press, comprising:

a mounting bracket securable to a press over the ink fountain of such press;

a feeder housing attached to said bracket and including a top and a bottom wherein said top is spaced above said bottom sufficiently to receive an ink storage container and including guide means for locating an ink storage container within said housing;

means forming an opening through said bottom of said housing by which ink can be expelled downwardly into the press fountain directly from an ink container located in said feeder housing;

ram means mounted adjacent said top of said housing and including an expeller plate corresponding in shape to the cross-sectional configuration of the ink container and movable downward in alignment with said guide means into the container to expel ink out through a hole in the container bottom; and means for actuating said ram means as the ink in the press fountain is depleted during press operation.

6. A feeder for printing ink as defined in claim 5, wherein said means for actuating said ram means includes a double acting pneumatic cylinder mounted over said top of said feeder housing and aligned with said guide means, sensing means for sensing when said cylinder has extended said expeller plate to the bottom of an ink container to signal the container is empty.

7. A feeder for ink as defined in claim 5, said means for actuating said ram means including a pneumatic cylinder connected to advance said ram means for pushing ink from a container;

control means for controlling the operation of said cylinder including timer means for periodically advancing said cylinder;

a solenoid operated valve controlling supply of pneumatic fluid to said cylinder to advance said ram means;

a relay controlling power to said solenoid operated valve;

said timer means controlling said relay and having adjustable controls for setting on and off time for powering said relay, thereby causing periodic actuation of said solenoid operated valve for extending said ram means incrementally and periodically expelling a quantity of ink out of the ink container.

8. An ink feeder as defined in claim 7, wherein said control means further comprises:

a second relay responsive to emptying of said ink container and connected to cause deactivating said first relay and to cause said pneumatic cylinder to retract said ram.

9. A feeder for printing ink as defined in claim 5, wherein said guide means align said hole in said bottom of said housing with said hole in said container.

10. A feeder for printing ink as defined in claim 9, wherein said guide means is adapted to locate container having different diameters with said housing.

11. A feeder for printing ink as defined in claim 5, wherein said guide means is adapted to locate containers having different diameters with said housing.

12. A feeder for printing ink as defined in claim 5, further comprising a diaphragm member located below and in contact with said expeller plate, said diaphragm member being sized and adapted to contact the interior of a container for minimizing leakage of ink between the container wall and the periphery of said expeller plate.

13. A feeder for expelling printing ink from an ink storage container directly into an ink fountain of a printing press, comprising:

support means for engaging and supporting a bottom surface of an ink storage container over the ink fountain of the press, said support means being adapted to engage and support containers having different diameters thereon and including means defining an ink passage therethrough;

a ram means located over said support means and having an expeller plate slidably receivable in a container positioned on said support means for pushing ink out of a hole in the bottom of the container and through said ink passage in said support means directly into said ink fountain;

a diaphragm member located below and in contact with said expeller plate, said diaphragm member being sized and adapted to contact the interior of said container for minimizing leakage of ink between the container wall and the periphery of said expeller plate, and said diaphragm member being adapted to remain in the container so as to protect any remaining ink therein from deterioration due to air exposure.

14. A feeder for printing ink as defined in claim 13, wherein said support means includes guide means for aligning the hole in said container with said ink passage in said support means.

* * * * *